US008160286B2

(12) United States Patent
Koike et al.

(10) Patent No.: US 8,160,286 B2
(45) Date of Patent: Apr. 17, 2012

(54) SPEAKER SYSTEM

(75) Inventors: Toshiyuki Koike, Mie (JP); Hidekazu Tanaka, Singapore (SG); Soo Chen Lai, Singapore (SG); Thomas Chee Wee Leow, Singapore (SG)

(73) Assignee: Panasonic Corporation, Osaka (JP)

( * ) Notice: Subject to any disclaimer, the term of this patent is extended or adjusted under 35 U.S.C. 154(b) by 846 days.

(21) Appl. No.: 12/281,553

(22) PCT Filed: Mar. 31, 2006

(86) PCT No.: PCT/JP2006/306842

§ 371 (c)(1),
(2), (4) Date: Oct. 23, 2008

(87) PCT Pub. No.: WO2007/125569

PCT Pub. Date: Nov. 8, 2007

(65) Prior Publication Data

US 2011/0243361 A1 Oct. 6, 2011

(51) Int. Cl.
*H04R 25/00* (2006.01)

(52) U.S. Cl. ..... 381/349; 381/345; 381/182

(58) Field of Classification Search ..... 381/345–350, 381/353–354, 182, 423–425, 429
See application file for complete search history.

(56) References Cited

U.S. PATENT DOCUMENTS 6,626,263 B2 * 9/2003 Sahyoun ..... 381/349
6,658,129 B2 * 12/2003 D'Hoogh ..... 381/349
6,704,426 B2 * 3/2004 Croft, III ..... 381/351
6,782,112 B1 * 8/2004 Geddes ..... 381/351
7,133,533 B2 * 11/2006 Chick et al. ..... 381/349

FOREIGN PATENT DOCUMENTS

JP 57-160288 U 10/1982
JP 57-199399 12/1982
JP 01-086395 U 6/1989
JP 2005-268948 A 9/2005

OTHER PUBLICATIONS

Chinese Office Action for Application No. 200680054049.9, Mar. 10, 2011, Panasonic Corporation.
Microfilm of the specification and drawings annexed to the request of Japanese Utility Model Application No. 47460/1981 (Laid-open No. 160288/1982), Mitsubishi Electric Corp., Oct. 7, 1982.
Microfilm of the specification and drawings annexed to the request of Japanese Utility Model Application No. 180640/1987 (Laid-open No. 86395/1989), Pioneer Electronic Corp., Jun. 7, 1989.
Microfilm of the specification and drawings annexed to the request of Japanese Utility Model Application No. 78219/1980 (Laid-open No. 2790/1982), Pioneer Electronics Corporation, Jan. 8, 1982.
International Search Report for International Application No. PCT/JP2006/306842 dated Aug. 8, 2006.

* cited by examiner

*Primary Examiner* — Suhan Ni
(74) *Attorney, Agent, or Firm* — RatnerPrestia

(57) ABSTRACT

A loudspeaker device includes an enclosure, a loudspeaker unit and a passive radiator both mounted to the enclosure. The passive radiator includes an edge sandwiched and bonded between a first diaphragm and a second diaphragm. This structure allows increasing the bonding strength between the edge and the first diaphragm as well as between the edge and the second diaphragm, so that the loudspeaker device can withstand greater maximum inputs and reproduce quality bass sound.

14 Claims, 3 Drawing Sheets

SPEAKER SYSTEM

This application is a U.S. National Phase Application of PCT International Application PCT/JP2006/306842.

TECHNICAL FIELD

The present invention relates to a loudspeaker device, having a passive radiator, to be used in a video apparatus such as a thin and large size television receiver.

BACKGROUND ART

In recent years, a large size screen employing a plasma panel or a liquid crystal panel has been used in a television receiver featuring a thin body, and the large size and thin TV receivers have been well accepted in the market. This market trend requires that audio reproduction devices be downsized and thinner. At the same time, a home theater and the terrestrial digital broadcasting have prevailed in the market, and these media are capable of carrying quality sound. This market trend also requires that the audio reproduction devices reproduce quality sound and withstand greater maximum inputs.

One of the requests of reproducing the quality sound needs a reproduction technique of bass sound in order to reproduce dynamic sound incidental to cinemas. For instance, use of a passive radiator is one of the reproduction techniques of bass sound.

FIG. 7 shows a lateral sectional view of a conventional loudspeaker device having a passive radiator. Enclosure 1 has two openings 4*a* and 4*b* at its front, and loudspeaker unit 2 with magnetic circuit 2*a* is mounted to opening 4*a*. Passive radiator 3 is formed of flat diaphragm 3*b* and mounted to opening 4*b* via edge 3*a* supporting passive radiator 3.

In the conventional loudspeaker device discussed above, loudspeaker unit 2 produces exhaust pressure when it is driven, and this exhaust pressure is used for driving passive radiator 3. The drive of radiator 3 reinforces the reproduction of predetermined bass sound. This kind of conventional loudspeaker device is disclosed in, e.g. Unexamined Japanese Utility Model Publication No. S57-2790.

Diaphragm 3*b* and edge 3*a* are typically jointed with an adhesive, or by a molding resin. In the case of the molding resin, edge 3*a* is unitarily molded with diaphragm 3*b* through an outsert molding method. On the other hand, only diaphragm 3*b* is sometimes formed by cutting a board or through a molding process, and then diaphragm 3*b* is bonded to edge 3*a*. Since this bonding method needs no mold-die, it is advantageous cost-wise over the other method.

However, a stronger joint section between diaphragm 3*b* and edge 3*a* is required in the environment where larger and thinner video apparatuses as well as greater output from audio apparatuses are awaited.

DISCLOSURE OF INVENTION

A loudspeaker device of the present invention includes an enclosure, a loudspeaker and a passive radiator both mounted to the enclosure. The passive radiator includes a first diaphragm, a second diaphragm, and an edge, whose inner periphery is sandwiched and bonded between the first and the second diaphragms, and outer periphery is fixed to the enclosure. The foregoing structure allows strengthening the joint sections between the edge and the diaphragms, so that the loudspeaker device for reproducing bass sound can withstand greater maximum inputs.

DESCRIPTION OF REFERENCE MARKS

11 enclosure
11*a*, 11*b* opening
12 loudspeaker unit
12*a* magnetic circuit
12*b* magnetic gap
12*c* bottom plate
12*d* magnet
12*e* top plate
13 passive radiator
13*a* frame
13*b* edge
13*c* second diaphragm
13*d* first diaphragm
13*e* through-hole
13*f*, 13*k* ridge
13*i* tapped hole
13*j* opening

DESCRIPTION OF PREFERRED EMBODIMENTS

Exemplary embodiments of loudspeaker devices of the present invention are demonstrated hereinafter with reference to FIG. 1-FIG. 6.

Embodiment 1

Figure 1:
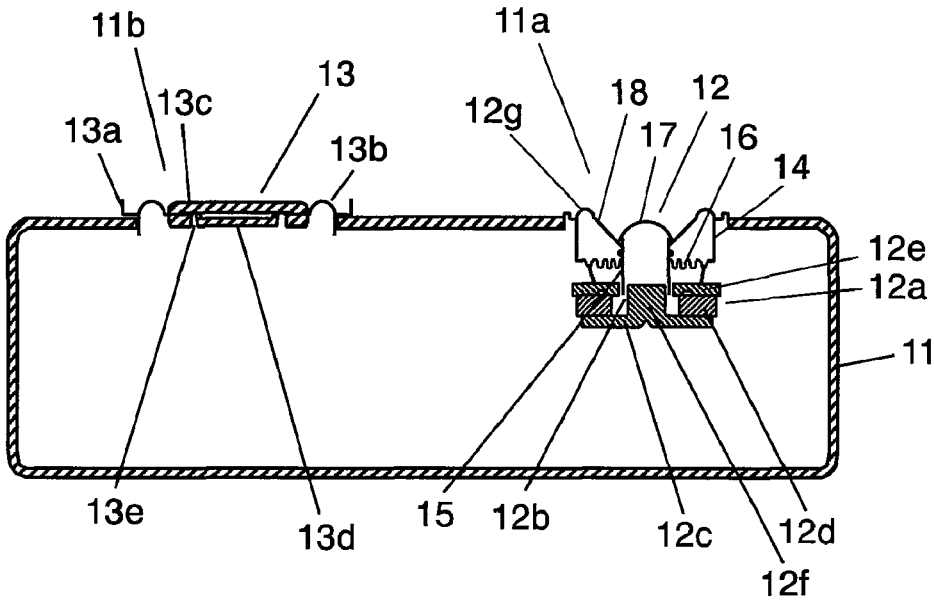
FIG. 1 shows a lateral sectional view of a loudspeaker device in accordance with an embodiment of the present invention.
Figure 2:
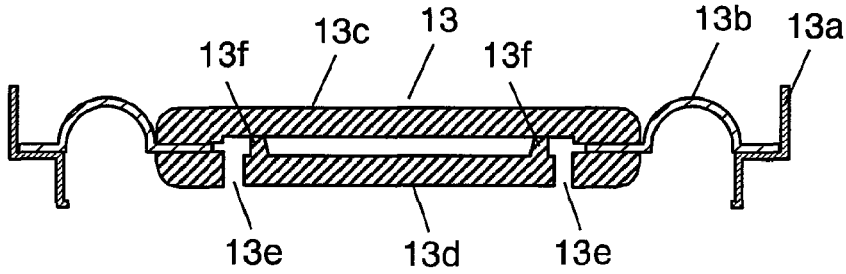
FIG. 2 shows a lateral sectional view of a passive radiator to be used in the loudspeaker device shown in FIG. 1.

FIG. 1 shows a lateral sectional view of a loudspeaker device in accordance with the first embodiment of the present invention. FIG. 2 shows a lateral sectional view of a passive radiator to be used in the loudspeaker device shown in FIG. 1, and FIG. 3 shows an exploded perspective view of the passive radiator shown in FIG. 2.

Figure 3:
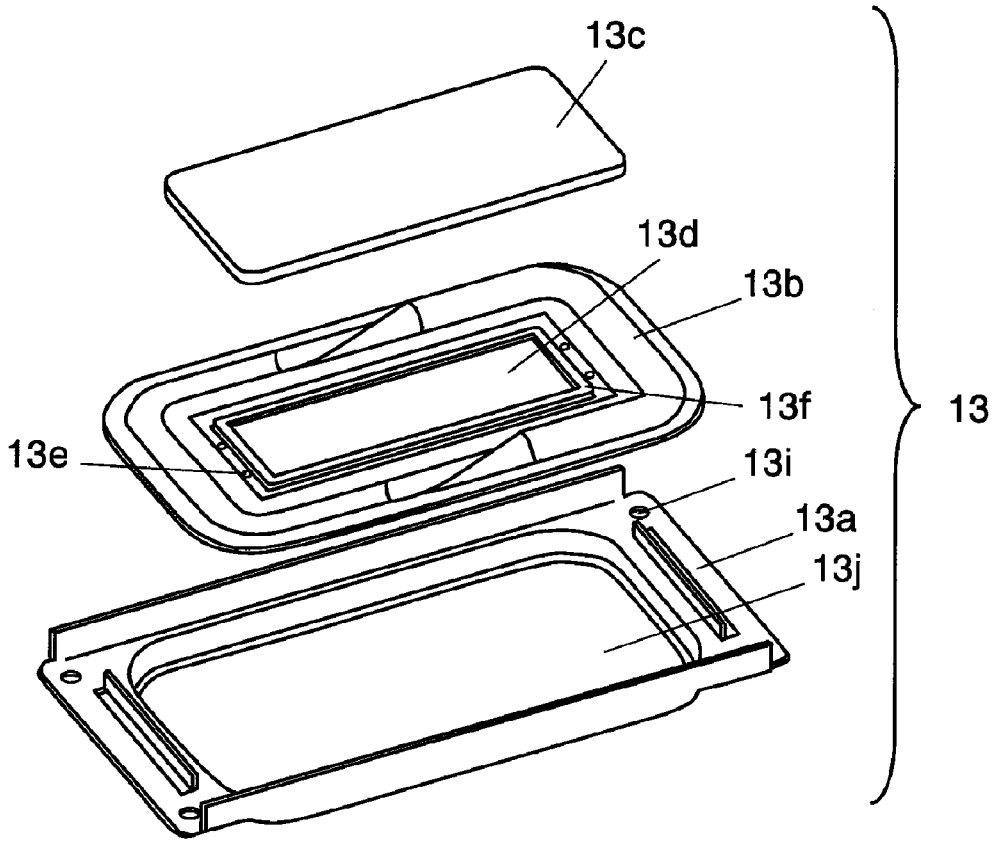
FIG. 3 shows an exploded perspective view of the passive radiator shown in FIG. 2.

As shown in FIG. 1-FIG. 3, enclosure 11 has two openings 11*a* and 11*b* at its front. Loudspeaker unit 12 is screwed down (not shown) to opening 11*a*, and rectangular passive radiator 13 is mounted to opening 11*b*.

Loudspeaker unit 12 includes magnetic circuit 12*a* for forming magnetic gap 12*b*, loudspeaker diaphragm 18 (hereinafter referred to as diaphragm 18), suspension 16, and dust cap 17. Magnetic circuit 12*a* is formed by bonding bottom plate 12*c*, annular magnet 12*d* and annular top plate 12*e* together. Bottom plate 12*c* includes center pole 12*f*. Diaphragm 18 is bonded to loudspeaker frame 14 (hereinafter simply referred to as frame 14) at its outer periphery, and an inner periphery thereof is bonded to voice coil 15. Magnetic gap 12*b* is formed at an end of voice coil 15. Suspension 16 is bonded to voice coil 15 at its inner periphery, and an outer periphery thereof is bonded to frame 14. Dust cap 17 covers voice coil 15 from the top. Frame 14 is bonded to top plate 12*e* at its bottom.

Passive radiator 13 includes frame 13*a*, edge 13*b*, first diaphragm 13*d* (hereinafter referred to as diaphragm 13*d*), and second diaphragm 13*c* (hereinafter referred to as diaphragm 13*c*). Frame 13*a* is made of thin metal sheet, and has rectangular opening 13*j*, and tapped hole 13*i* for mounting passive radiator 13 to enclosure 11. Edge 13*b* works as a supporter of diaphragms 13*c* and 13*d* for bonding diaphragms 13*c* and 13*d* to frame 13*a* at their outer periphery. Diaphragm 13*c* is made of rectangular plate molded of resin, and placed on the inner periphery of edge 13*b*. Diaphragm 13*c* is disposed at an outer surface of enclosure 11 and faces outside of enclosure 11. Diaphragm 13*d* is also made of rectangular plate molded of resin, and placed on the inner periphery of edge 13*b* and faces inside of enclosure 11.

Edge 13*b* is bonded to diaphragm 13*c*, edge 13*b* is also bonded to diaphragm 13*d* with adhesive, and edge 13*b* is sandwiched between diaphragms 13*c* and 13*d*.

As discussed above, edge 13*b* is sandwiched between and bonded to diaphragms 13*c* and 13*d*, so that the joint strength between edge 13*b* and diaphragm 13*c* as well as between edge 13*b* and diaphragm 13*d* increases. As a result, passive radiator 13 can withstand greater maximum inputs, and the loudspeaker device to be used for reproducing bass sound is thus obtainable with improved withstanding characteristics to the greater maximum inputs.

On top of that, a plurality of through-holes 13*e* is formed at a vicinity of a joint section between diaphragm 13*d* and edge 13*b*. In FIG. 3, through-holes 13*e* are formed along a short side of diaphragm 13*d*; however, they can be formed along a long side of diaphragm 13*d*, or they can be formed along both of the short and the long sides. Through-holes 13*e* are formed with a strength of diaphragm 13*d* being kept, i.e. they do not extremely decrease the strength of diaphragm 13*d*, and a formation of through-holes 13*e* can be appropriately selected depending on the necessity. For instance, a size of through-hole 13*e*, an interval between the respective through-holes 13*e*, a place of through-hole 13*e*, and numbers of through-holes 13*e* can be appropriately selected.

A presence of through-holes 13*e* gives adhesive greater opportunities of exposing themselves to an open air, where an adhesive is used for the joint section between diaphragm 13*c* and edge 13*b* as well as between diaphragm 13*d* and edge 13*b*. Because the open air enters into through-holes 13*e* and contacts with the adhesive applied between diaphragm 13*c* and edge 13*b* as well as between diaphragm 13*d* and edge 13*b*. The open air accelerates the adhesive to vaporize its solvent, so that dispersion in drying times of the respective joint sections can be improved, and a drying time can be shortened. As a result, a productivity of passive radiator 13 can be improved.

Diaphragm 13*d* includes ridge 13*f* along its entire periphery inside the joint section between diaphragm 13*d* and edge 13*b*. Ridge 13*f* is formed such that it can maintain the holding mechanism between edge 13*b* and diaphragm 13*c* as well as between edge 13*b* and diaphragm 13*d*. In other words, a height of ridge 13*f* is set appropriately to produce a pressure great enough for holding edge 13*b* sandwiched between diaphragms 13*c* and 13*d*.

A presence of ridge 13*f* forms a space corresponding to the height of ridge 13*f* between diaphragm 13*c* and diaphragm 13*d*. This space allows the adhesive between diaphragm 13*c* and edge 13*b* as well as between diaphragm 13*d* and edge 13*b* to increase an area contacting with the open air, so that the solvent contained in the adhesive is accelerated to vaporize along the entire periphery of diaphragm 13*d* via through-holes 13*e*. As a result, the dispersion in drying time is reduced, and the drying time is shortened.

Figure 4:
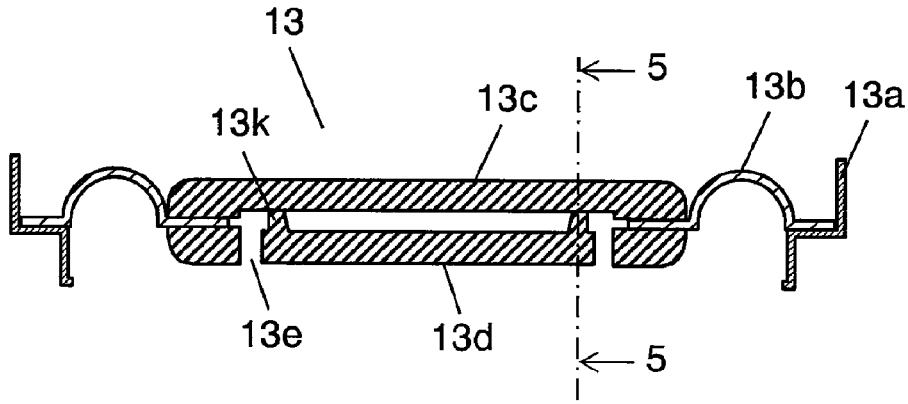
FIG. 4 shows a lateral sectional view of a passive radiator to be used in a loudspeaker device in accordance with another embodiment of the present invention.
Figure 5:
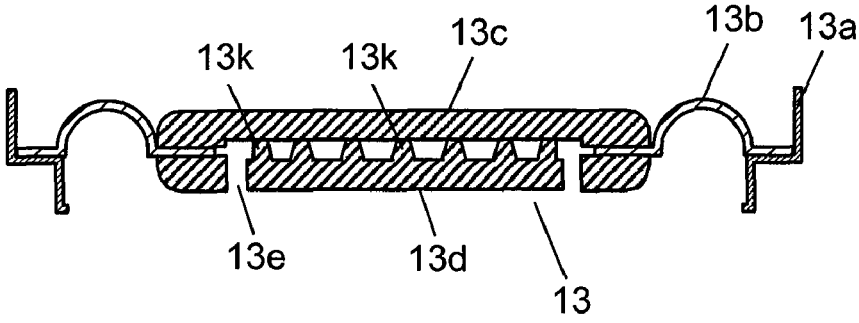
FIG. 5 shows a sectional view of the passive radiator cut along line 5-5 shown in FIG. 4.

FIG. 4 shows a lateral sectional view of a passive radiator in accordance with another embodiment. FIG. 5 shows a sectional view of the passive radiator cut along line 5-5 shown in FIG. 4. The ridge is not necessarily formed on the entire outer periphery of diaphragm 13*d*. For instance, it can be formed intermittently like ridges 13*k*. A formation of intermittent ridges 13*k* can be selected appropriately depending on the necessity. For instance, a length and a size, intervals between the respective ridges 13*k*, places, and numbers of ridges 13*k* can be selected appropriately when ridges 13*k* are disposed intermittently.

As discussed above, edge 13*b* is bonded to diaphragm 13*c* at a first face of its inner periphery and bonded to diaphragm 13*d* at a second face of its inner periphery with the adhesive. Edge 13*b* is thus sandwiched between diaphragms 13*c* and 13*d*. This structure allows increasing the bonding strength between edge 13*b* and diaphragm 13*c* as well as between edge 13*b* and diaphragm 13*d*, so that passive radiator 13 improves its withstanding characteristics to greater maximum inputs. As a result, the loudspeaker device for reproducing the bass sound improves its withstanding characteristics to the greater maximum inputs.

In the case of providing through-holes 13*e* to diaphragm 13*d* in addition to intermittent ridges 13*k*, the open air is supplied via through-holes 13*e*, thereby accelerating the adhesive to vaporize the solvent. This structure allows shortening the drying time of the adhesive. As a result, the productivity of passive radiator 13 is improved, which also improves the productivity of the loudspeaker device.

On top of that, ridge 13*f* or ridges 13*k* formed on diaphragm 13*d* allow forming a space between diaphragms 13*c* and 13*d*. This structure allows the adhesive at the respective joint sections to expose themselves in greater areas to the open air entering into through-holes 13*e*, so that the drying time of the adhesive can be shortened and the adhesive can be dried uniformly. As a result, the productivity of the loudspeaker device can be improved.

Figure 6:
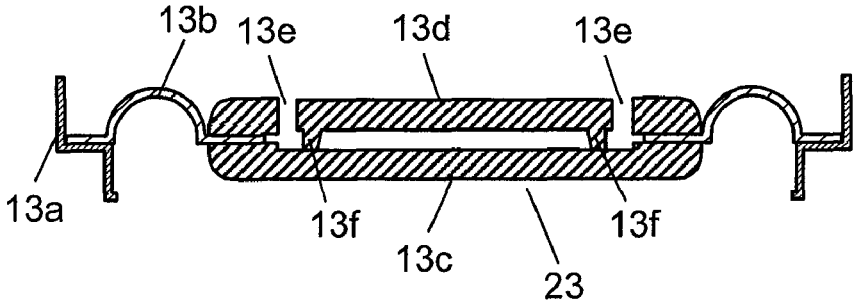
FIG. 6 shows a lateral sectional view of a passive radiator to be used in a loudspeaker device in accordance with still another embodiment of the present invention.
Figure 7:
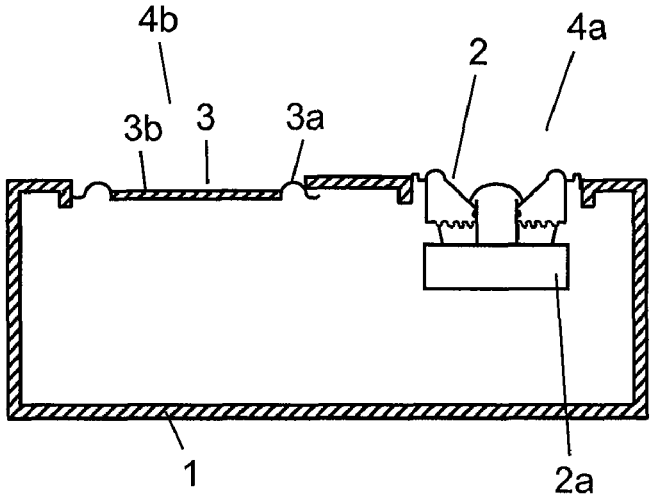
FIG. 7 PRIOR ART
FIG. 7 shows a lateral sectional view of a conventional loudspeaker device.

FIG. 6 shows a lateral sectional view of a passive radiator in accordance with still another embodiment. In the foregoing description, through-holes 13*e* are provided to diaphragm 13*d*, and diaphragm 13*d* is placed on the inner periphery of edge 13*b* and faces inside of enclosure 11. However, as shown in FIG. 6, first diaphragm 13*d* can be placed on the inner periphery of edge 13*b*, and is disposed at the outer surface and faces outside of enclosure 11. As shown in FIG. 6, second diaphragm 13*c* can be placed on the inner periphery of edge 13*b*, and is disposed inside enclosure 11 and faces inside of enclosure 11. Passive radiator 23 employing this structure has through-holes 13*e* provided to the outer surface of enclosure 11. In this case, dust entering between diaphragms 13*c* and 13*d* is preferably taken into consideration, or a dust-proof countermeasure is preferably taken. For instance, after the adhesive, which bonds edge 13*b* to diaphragm 13*c* as well as edge 13*b* to diaphragm 13*d*, is dried, application of adhesive (not shown) for sealing through-holes 13*e* is one of the dust-proof countermeasures.

In the previous discussions, through-holes 13*e*, ridge 13*f* or ridges 13*k* are formed on diaphragm 13*d*. In this case, diaphragm 13*c* remains a simple flat plate, so that diaphragm 13*c* can be formed with ease and its manufacturing cost stays at a low level.

However, through-holes 13*e* can be formed on diaphragm 13*d*, and ridge 13*f* or ridges 13*k* can be formed on diaphragm 13*c*. In this case, diaphragms 13*c* and 13*d* maintain their mechanical strength and accuracy, while the appropriate places of through-holes 13*e*, ridge 13*f* or ridges 13*k* can be determined with ease for drying the adhesive.

INDUSTRIAL APPLICABILITY

A loudspeaker device of the present invention allows its passive radiator to withstand greater maximum inputs, so that the loudspeaker device can be used for reproducing bass sound not only of electronic apparatuses such as audio-video apparatuses, game apparatuses but also of on-vehicle apparatuses.

The invention claimed is:

1. A loudspeaker device comprising:
an enclosure;
a loudspeaker unit mounted to the enclosure; and
a passive radiator mounted to the enclosure,
wherein the passive radiator includes:
a first diaphragm;
a second diaphragm, the first diaphragm and the second diaphragm having respective inner surfaces facing each other; and
an edge having an inner periphery bonded to the first diaphragm and the second diaphragm, and an outer periphery fixed to the enclosure.

2. The loudspeaker device of claim 1,
wherein the first diaphragm includes a plurality of through-holes.

3. The loudspeaker device of claim 2,
wherein the first diaphragm further includes a ridge disposed inwardly from the through-holes, and
the ridge is formed along an entire outer periphery of the first diaphragm.

4. The loudspeaker device of claim 2,
wherein the first diaphragm further includes a ridge disposed inwardly from the through-holes, and
the ridge is formed intermittently along an entire outer periphery of the first diaphragm.

5. The loudspeaker device of claim 1,
wherein the first diaphragm is disposed and faces inside of the enclosure.

6. The loudspeaker device of claim 1,
wherein the first diaphragm is disposed at an outer surface and faces outside of the enclosure.

7. The loudspeaker device of claim 2,
wherein the first diaphragm is disposed and faces inside of the enclosure.

8. The loudspeaker device of claim 3,
wherein the first diaphragm is disposed and faces inside of the enclosure.

9. The loudspeaker device of claim 4,
wherein the first diaphragm is disposed and faces inside of the enclosure.

10. The loudspeaker device of claim 2,
wherein the first diaphragm is disposed at an outer surface and faces outside of the enclosure.

11. The loudspeaker device of claim 3,
wherein the first diaphragm is disposed at an outer surface and faces outside of the enclosure.

12. The loudspeaker device of claim 4,
wherein the first diaphragm is disposed at an outer surface and faces outside of the enclosure.

13. The loudspeaker device of claim 1, wherein the inner periphery of the edge is bonded to the inner surface of each of the first diaphragm and the second diaphragm.

14. The loudspeaker device of claim 1, wherein the first diaphragm includes a ridge disposed on the inner surface along a periphery of the first diaphragm, the ridge contacting the second diaphragm.

* * * * *